US008897688B2

(12) United States Patent
Hasegawa

(10) Patent No.: US 8,897,688 B2
(45) Date of Patent: Nov. 25, 2014

(54) FIXING DEVICE AND IMAGE FORMING APPARATUS

(71) Applicant: Kenichi Hasegawa, Kanagawa (JP)

(72) Inventor: Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/048,531

(22) Filed: Oct. 8, 2013

(65) Prior Publication Data

US 2014/0119787 A1 May 1, 2014

(30) Foreign Application Priority Data

Oct. 29, 2012 (JP) ..... 2012-237588

(51) Int. Cl.
*G03G 15/20* (2006.01)

(52) U.S. Cl.
CPC ..... *G03G 15/2064* (2013.01); *G03G 15/2025* (2013.01); *G03G 15/2053* (2013.01)
USPC ..... 399/329

(58) Field of Classification Search
CPC ..... G03G 15/2064; G03G 15/2075
USPC ..... 399/329
See application file for complete search history.

(56) References Cited

U.S. PATENT DOCUMENTS

2007/0292175 A1 12/2007 Shinshi
2011/0008084 A1* 1/2011 Okamoto ..... 399/329
2011/0135353 A1* 6/2011 Creteau et al. ..... 399/329
2011/0170917 A1* 7/2011 Yoshikawa et al. ..... 399/329
2011/0206426 A1* 8/2011 Komuro ..... 399/329
2011/0222934 A1 9/2011 Hasegawa
2012/0076556 A1* 3/2012 Komuro ..... 399/329
2012/0251208 A1 10/2012 Hasegawa
2013/0034720 A1* 2/2013 Maniwa ..... 428/316.6
2014/0119787 A1* 5/2014 Hasegawa ..... 399/329

FOREIGN PATENT DOCUMENTS

| | | |
|---|---|---|
| JP | 4-050883 | 2/1992 |
| JP | 2004-198556 | 7/2004 |
| JP | 2004-252354 | 9/2004 |
| JP | 2006-38990 | 2/2006 |
| JP | 2007-334205 | 12/2007 |
| JP | 2011-191380 | 9/2011 |
| JP | 2012-068428 | 4/2012 |
| JP | 2012-220503 | 11/2012 |
| JP | 2012-242550 | 12/2012 |

* cited by examiner

*Primary Examiner* — W B Perkey
(74) *Attorney, Agent, or Firm* — Harness, Dickey & Pierce, P.L.C.

(57) ABSTRACT

A fixing device includes a nip formation pad contacting a part of an outer circumferential surface of an interior rotary body sliding thereover and a fixing belt looped over the interior rotary body and the nip formation pad. A pressing rotary body is pressed against the nip formation pad via the fixing belt to form a fixing nip between the pressing rotary body and the fixing belt. A lubricant applicator is mounted on the nip formation pad to apply a lubricant to the outer circumferential surface of the interior rotary body. The pressing rotary body, the fixing belt, the nip formation pad, and the interior rotary body are aligned in this order in a pressurization direction in which the pressing rotary body exerts pressure to the interior rotary body via the fixing belt and the nip formation pad to form the fixing nip.

17 Claims, 5 Drawing Sheets

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2012-237588, filed on Oct. 29, 2012, in the Japanese Patent Office, the entire disclosure of which is hereby incorporated by reference herein.

BACKGROUND

1. Technical Field

Example embodiments generally relate to a fixing device and an image forming apparatus, and more particularly, to a fixing device for fixing a toner image on a recording medium and an image forming apparatus incorporating the fixing device.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

The image forming apparatuses are requested to form a high quality color toner image on a recording medium at high speed with downsized components. To address those requests, the fixing devices incorporated in the image forming apparatuses are requested to exert increased pressure to the toner image on the recording medium for an extended time while facilitating conveyance of the recording medium. Such fixing devices may employ various types of configurations such as a roller type and a belt type. FIG. 1 illustrates a roller type fixing device 25R1 including a fixing roller 91 and a pressing roller 92 pressed against the fixing roller 91 to form a fixing nip N therebetween through which a recording medium P bearing a toner image is conveyed. The fixing roller 91 is constructed of a metal tube 93 and a rubber layer 95 coating the metal tube 93 and accommodates a halogen heater 97. Similarly, the pressing roller 92 is constructed of a metal tube 94 and a rubber layer 96 coating the metal tube 94 and accommodates a halogen heater 98. As the recording medium P is conveyed through the fixing nip N, the fixing roller 91 heated by the halogen heater 97 and the pressing roller 92 heated by the halogen heater 98 apply heat and pressure to the recording medium P, fixing the toner image on the recording medium P. The rubber layers 95 and 96 may constitute an increased thermal resistance. To address this circumstance, the rubber layers 95 and 96 may be formed in a thin layer. However, the thin rubber layers 95 and 96 may produce the fixing nip N having a reduced length in a recording medium conveyance direction where the fixing roller 91 and the pressing roller 92 may apply heat and pressure to the recording medium P insufficiently.

FIG. 2 illustrates a belt type fixing device 25R2 including a fixing belt 77 stretched across a heating roller 78 and a fixing roller 74. A pressing roller 72 is pressed against the fixing roller 74 via the fixing belt 77 to form a fixing nip N between the pressing roller 72 and the fixing belt 77. As a recording medium P bearing a toner image is conveyed through the fixing nip N, the fixing belt 77 indirectly heated by a heater 84 through the heating roller 78 and the pressing roller 72 heated by a heater 86 apply heat and pressure to the recording medium P, thus fixing the toner image on the recording medium P.

Since the fixing roller 74 includes a rubber layer thicker than the rubber layer 95 of the fixing roller 91 of the fixing device 25R1 depicted in FIG. 1, the fixing roller 74 forms the greater fixing nip N. However, the fixing roller 74 is required to have a greater diameter that decreases the curvature of the fixing roller 74. Accordingly, the recording medium P, as it is discharged from the fixing nip N, may be wound around the fixing belt 77 stretched across the relatively great fixing roller 74. Further, the relatively great fixing roller 74 may upsize the fixing device 25R2.

In order to prevent the recording medium P from being wound around the fixing belt 77, the fixing belt 77 may be looped over a stationary, nip formation pad as disclosed by JP-2004-252354-A and JP-2004-198556-A. For example, a fixing belt may be looped over the nip formation pad and a smaller fixing roller to produce a fixing nip having an increased length in the recording medium conveyance direction. Although the fixing belt slides over the nip formation pad, the fixing roller decreases frictional resistance between the nip formation pad and the fixing belt sliding thereover, facilitating rotation of the fixing belt.

Since the nip formation pad and the fixing roller create an increased curvature of the fixing belt looped thereover, the recording medium discharged from the fixing nip separates from the fixing belt readily. However, the small nip formation pad may not endure increased pressure from the pressing roller.

In order to increase endurance against pressure from the pressing roller, a stationary, tubular heat conductor may be employed. For example, as disclosed by JP-2007-334205-A, the heat conductor having an increased diameter faces an inner circumferential surface of the fixing belt and heats the fixing belt. However, since the great heat conductor decreases the curvature of the fixing belt, the recording medium discharged from the fixing nip may be wound around the fixing belt.

On the other hand, in order to decrease frictional resistance between the nip formation pad and the fixing belt sliding thereover, a lubricant may be applied between the nip formation pad and the fixing belt. For example, as disclosed by JP-2006-038990-A, a lubricant guide disposed inside a loop formed by the fixing belt guides the lubricant applied to the inner circumferential surface of the fixing belt to a center of the fixing belt in an axial direction thereof. Accordingly, the lubricant guide moves the lubricant to an interface between the nip formation pad and the fixing belt sliding thereover, thus preventing torque required to drive and rotate the fixing belt from increasing and therefore facilitating conveyance of the recording medium by the fixing belt.

However, since the lubricant guide merely moves the lubricant, the lubricant applied to the inner circumferential surface of the fixing belt may be consumed over time. Moreover, if an additional component to retain the lubricant on the fixing belt is employed, it may upsize the fixing device.

SUMMARY

At least one embodiment provides a novel fixing device that includes an interior rotary body rotatable in a given direction of rotation and a heater disposed opposite and heating the interior rotary body. A nip formation pad contacts a part of an outer circumferential surface of the interior rotary body sliding thereover. A flexible fixing belt is looped over the interior rotary body and the nip formation pad. A pressing rotary body is pressed against the nip formation pad via the fixing belt to form a fixing nip between the pressing rotary body and the fixing belt. A lubricant applicator is mounted on the nip formation pad to apply a lubricant to the outer circumferential surface of the interior rotary body. The pressing rotary body, the fixing belt, the nip formation pad, and the interior rotary body are aligned in this order in a pressurization direction in which the pressing rotary body exerts pressure to the interior rotary body via the fixing belt and the nip formation pad to form the fixing nip.

At least one embodiment provides a novel image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
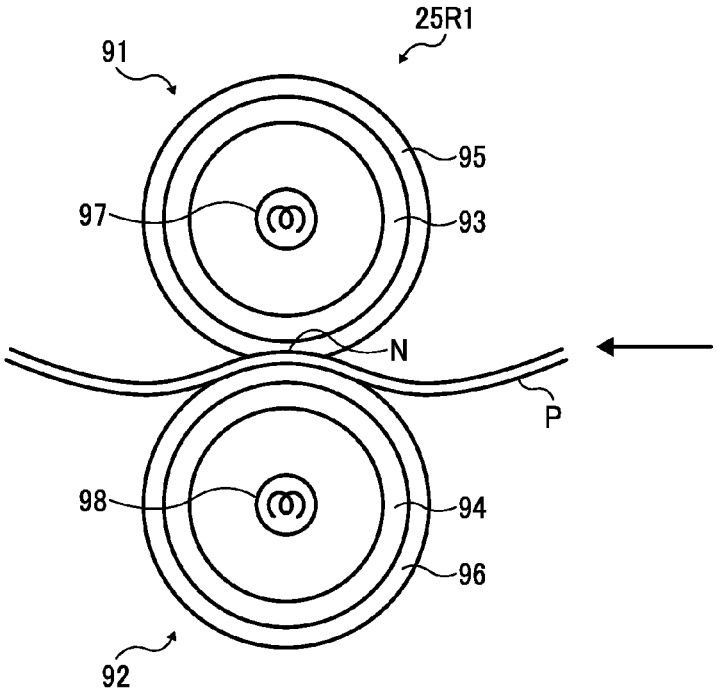
FIG. 1 RELATED ART
FIG. 1 is a vertical sectional view of a related-art fixing device.
Figure 2:
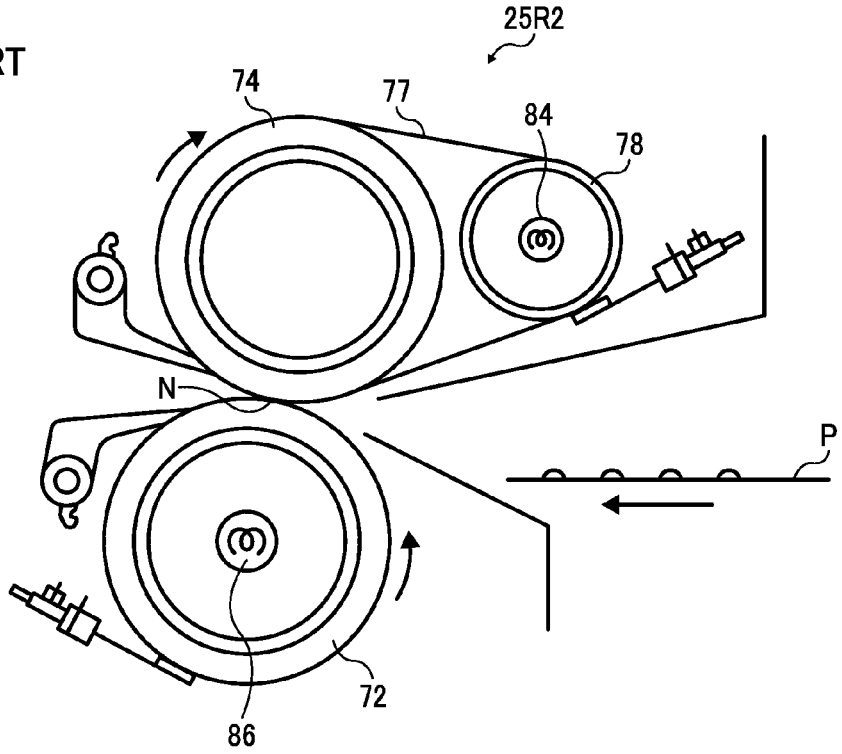
FIG. 2 RELATED ART
FIG. 2 is a vertical sectional view of another related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
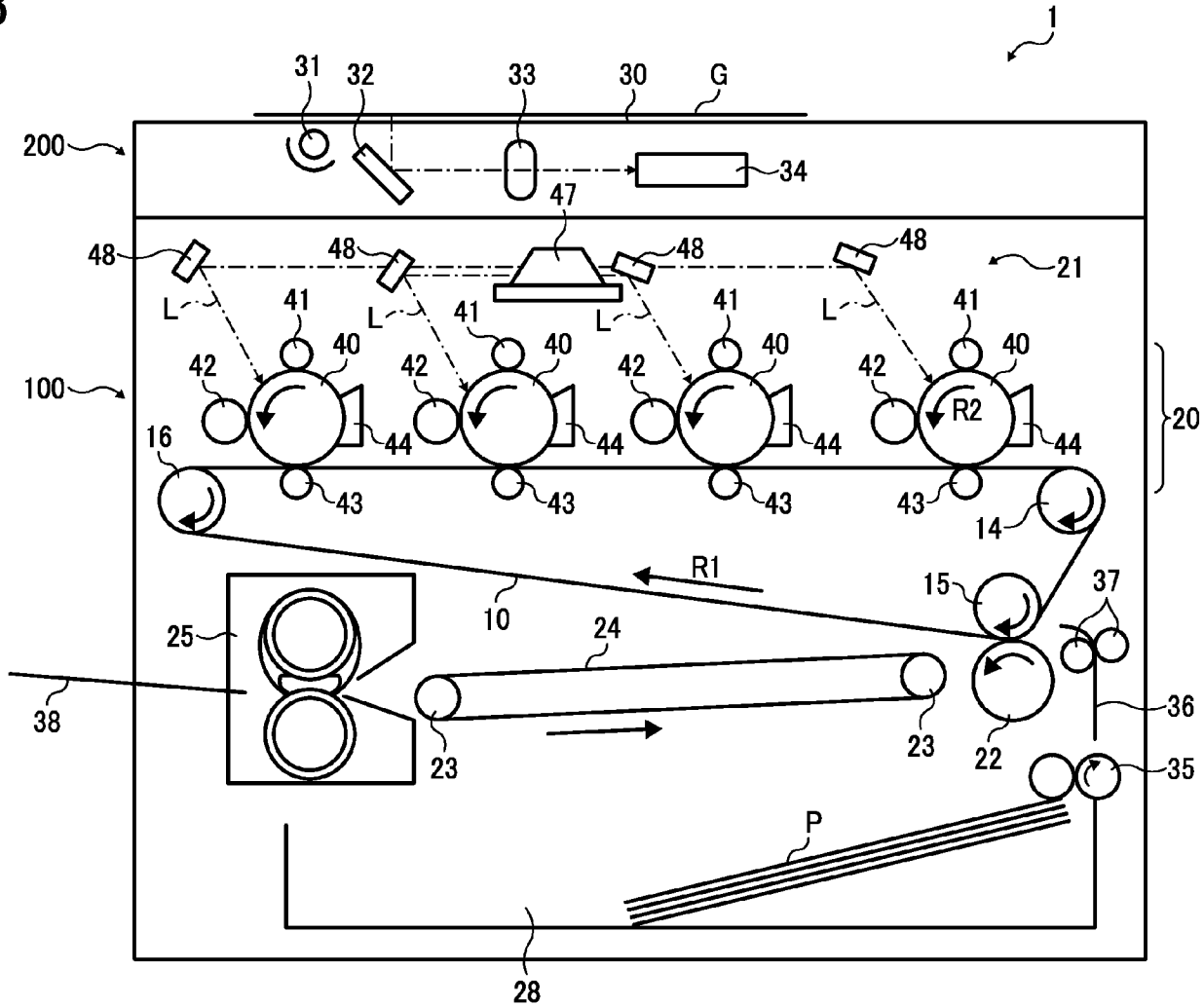
FIG. 3 is a schematic vertical sectional view of an image forming apparatus according to an example embodiment of the present invention.

Referring now to the drawings, wherein like reference numerals designate identical or corresponding parts throughout the several views, particularly to FIG. 3, an image forming apparatus 1 according to an example embodiment is explained.

FIG. 3 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color copier that forms color and monochrome toner images on recording media by electrophotography.

As shown in FIG. 3, the image forming apparatus 1 includes a body 100 and a scanner 200 disposed atop the body 100. The body 100 includes an endless belt-shaped intermediate transferor 10 looped over a driving roller 14, a first driven roller 15, and a second driven roller 16 and rotatable clockwise in FIG. 3 in a rotation direction R1. Alternatively, the intermediate transferor 10 may be looped over four or more rollers including a roller configured to correct skew of the intermediate transferor 10. Further, the intermediate transferor 10 may extend horizontally as shown in FIG. 3 or obliquely.

Above the intermediate transferor 10 stretched taut across the driving roller 14 and the second driven roller 16 is a tandem image forming device 20 constructed of four image forming units for forming black, yellow, magenta, and cyan toner images, respectively, and aligned in the rotation direction R1 of the intermediate transferor 10. Above the tandem image forming device 20 is an exposure device 21.

A detailed description is now given of a construction of the tandem image forming device 20 described above.

Each of the four image forming units incorporated in the tandem image forming device 20 is constructed of a drum-shaped image carrier 40 (e.g., a photoconductor), and a charger 41, a development device 42, a primary transfer device 43, a cleaner 44, and a discharger that surround the image carrier 40. A part or all of the components constituting the image forming unit may be formed in a process cartridge detachably attached to the body 100 collectively to facilitate maintenance.

For example, the charger 41 includes a charging roller that contacts the image carrier 40 to apply a voltage so as to charge the image carrier 40. The development device 42 uses a two-component developer containing magnetic carriers and non-magnetic toner. The primary transfer device 43 is pressed against the image carrier 40 via the intermediate transferor 10. According to this example embodiment, the primary transfer device 43 is a roller. Alternatively, the primary transfer device 43 may include a brush or a non-contact charger. The cleaner 44 includes a cleaning blade or a cleaning brush that contacts the image carrier 40 to remove residual toner remaining on the image carrier 40 therefrom. The discharger includes a lamp that emits light onto the image carrier 40 to initialize a surface potential thereof.

A description is provided of image forming processes performed by the image forming device 20 described above.

As each image carrier 40 rotates counterclockwise in FIG. 3 in a rotation direction R2, the charger 41 uniformly charges an outer circumferential surface of the image carrier 40. In the exposure device 21, a light source (e.g., a light-emitting diode (LED)) emits light L (e.g., a laser beam) toward a polygon minor 47 according to image data created by the scanner 200. The polygon minor 47 reflects the light L toward a minor 48 that in turn reflects the light L onto the image carrier 40, thus forming an electrostatic latent image thereon.

Thereafter, the development devices 42 supply black, yellow, magenta, and cyan toners to the electrostatic latent images formed on the image carriers 40, rendering the electrostatic latent images visible as black, yellow, magenta, and cyan toner images, respectively. The primary transfer devices 43 primarily transfer the black, yellow, magenta, and cyan toner images from the image carriers 40 onto the intermediate transferor 10, respectively, such that the black, yellow, magenta, and cyan toner images are superimposed on a same position on the intermediate transferor 10 to form a color toner image thereon. After the primary transfer, the cleaners 44 remove residual toners failed to be transferred onto the intermediate transferor 10 and therefore remaining on the outer circumferential surface of the respective image carriers 40 therefrom. Thereafter, the dischargers discharge the image carriers 40. Thus, the four image forming units of the image forming device 20 become ready for the next image forming processes.

Below the intermediate transferor 10 is a secondary transfer device 22 including a roller pressed against the first driven roller 15 via the intermediate transferor 10 to form a secondary transfer nip between the secondary transfer device 22 and the intermediate transferor 10. As a recording medium P (e.g., a sheet) is conveyed through the secondary transfer nip while the secondary transfer device 22 presses the recording medium P against the intermediate transferor 10, the secondary transfer device 22 secondarily transfers the color toner image formed on the intermediate transferor 10 onto the recording medium P. Downstream from the secondary transfer device 22 in the rotation direction R1 of the intermediate transferor 10 is an endless conveyance belt 24 looped over two rollers 23. Downstream from the conveyance belt 24 in the rotation direction R1 of the intermediate transferor 10 is a fixing device 25 that fixes the color toner image on the recording medium P.

An intermediate transferor cleaner disposed opposite the intermediate transferor 10 may be situated in proximity to the second driven roller 16 to remove residual toner failed to be transferred onto the recording medium P and therefore remaining on the intermediate transferor 10 therefrom.

The secondary transfer device 22 also conveys the recording medium P bearing the color toner image after the secondary transfer. Alternatively, the secondary transfer device 22 may include a non-contact charger instead of the roller. In this case, a separate component other than the non-contact charger conveys the recording medium P toward the conveyance belt 24.

Below the secondary transfer device 22, the conveyance belt 24, and the fixing device 25 is a paper tray 28 that loads a plurality of recording media P such as sheets and overhead projector (OHP) transparencies.

A description is provided of a copying operation performed by the image forming apparatus 1 having the construction described above.

A user places an original G on an exposure glass 30 disposed atop the scanner 200 and lowers a top cover to render the top cover to press the original G against the exposure glass 30. As the user presses a start button disposed atop the scanner 200 to drive the scanner 200, the scanner 200 reads an image on the original G. For example, a light source 31 (e.g., a halogen lamp) emits light onto the original G through the exposure glass 30. A mirror 32 reflects the light reflected by the original G toward a lens 33 that gathers the light. The gathered light enters a charge-coupled device (CCD) 34 that forms an image and converts the image into an electric signal.

Simultaneously, as the user presses the start button, a driver (e.g., a motor) drives and rotates the driving roller 14 clockwise in FIG. 3. The driving roller 14 rotates the intermediate transferor 10 clockwise in the rotation direction R1 by friction therebetween, which in turn rotates the first driven roller 15 and the second driven roller 16. The black, yellow, magenta, and cyan toner images formed on the image carriers 40, respectively, as described above are primarily transferred onto the intermediate transferor 10 rotating in the rotation direction R1 such that the black, yellow, magenta, and cyan toner images are superimposed on the same position on the intermediate transferor 10 and formed into a color toner image.

On the other hand, a feed roller 35, as it rotates clockwise in FIG. 3, picks up and feeds a recording medium P from the paper tray 28 toward a recording medium conveyance path 36. As the recording medium P comes into contact with a registration roller pair 37, the registration roller pair 37 interrupting its rotation halts the recording medium P. At a time when the color toner image formed on the intermediate transferor 10 reaches the secondary transfer device 22, the registration roller pair 37 resumes its rotation to feed the recording medium P to the secondary transfer nip formed between the secondary transfer device 22 and the intermediate transferor 10. As the recording medium P is conveyed through the secondary transfer nip, the secondary transfer device 22 secondarily transfers the color toner image from the intermediate transferor 10 onto the recording medium P, thus forming the color toner image on the recording medium P.

Thereafter, the recording medium P bearing the color toner image is conveyed by the conveyance belt 24 to the fixing device 25. The fixing device 25 applies heat and pressure to the recording medium P, fixing the color toner image on the recording medium P. Then, the recording medium P bearing the fixed color toner image is discharged and stacked onto an output tray 38.

After the secondary transfer, the intermediate transferor cleaner removes residual toner failed to be transferred onto the recording medium P and therefore remaining on the intermediate transferor 10 therefrom. Thus, the image forming device 20 is ready for the next image forming processes.

Figure 4:
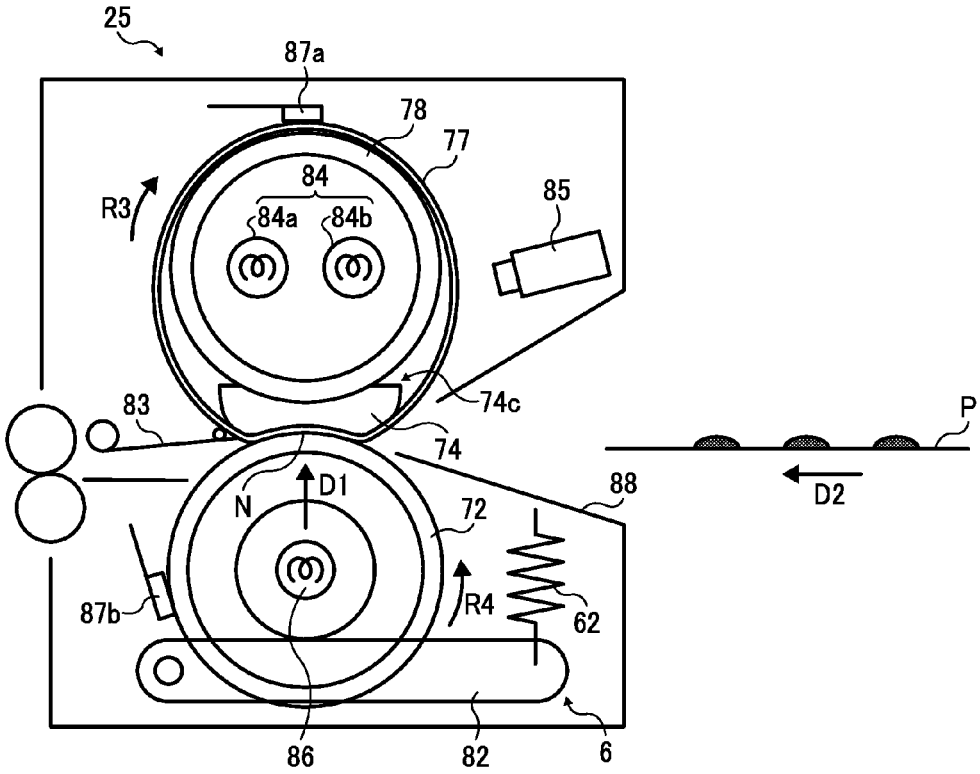
FIG. 4 is a vertical sectional view of a fixing device according to a first example embodiment incorporated in the image forming apparatus shown in FIG. 3.
Figure 5:
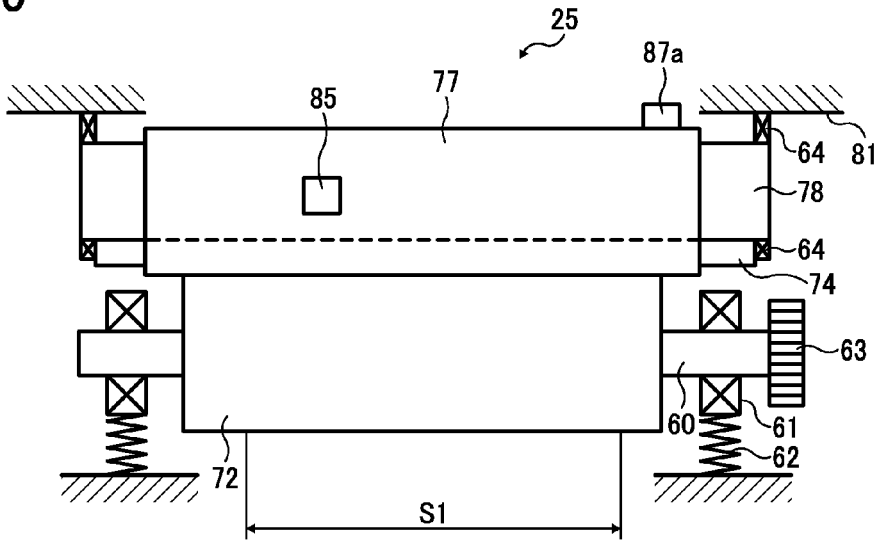
FIG. 5 is a side view of the fixing device shown in FIG. 4.

With reference to FIGS. 4 and 5, a description is provided of a construction of the fixing device 25 according to a first example embodiment incorporated in the image forming apparatus 1 described above.

FIG. 4 is a vertical sectional view of the fixing device 25. FIG. 5 is a side view of the fixing device 25. As shown in FIG. 4, the fixing device 25 (e.g., a fuser) includes a heating roller 78 serving as an interior rotary body rotatable clockwise in FIG. 4 in a rotation direction R3; a heater pair 84 serving as a heater or a heat source that heats the heating roller 78; a nip formation pad 74 that contacts a part of an outer circumferential surface of the heating roller 78 such that the heating roller 78 slides over the nip formation pad 74; a flexible endless fixing belt 77 looped over the heating roller 78 and the nip formation pad 74; and a pressing roller 72 serving as a pressing rotary body pressed against the nip formation pad 74 via the fixing belt 77 to form a fixing nip N between the pressing roller 72 and the fixing belt 77. The pressing roller 72, the fixing belt 77, the nip formation pad 74, and the heating roller 78 are aligned in this order in an upward pressurization direction D1 in FIG. 4 in which the pressing roller 72 exerts pressure to the heating roller 78 via the fixing belt 77 and the nip formation pad 74 at the fixing nip N. The fixing device 25 further includes a lubricant applicator described below mounted on the nip formation pad 74 to apply a lubricant to the outer circumferential surface of the heating roller 78.

In this specification, a "circumferential direction" defines the rotation direction R3 of the heating roller 78 and an "axial direction" defines an axial direction of the heating roller 78 unless otherwise specified.

FIG. 4 illustrates a pressurization state in which the pressing roller 72 is pressed against the nip formation pad 74 via the fixing belt 77 to form the fixing nip N between the pressing roller 72 and the fixing belt 77 where the fixing belt 77 and the pressing roller 72 apply heat and pressure to a recording medium P to fix a toner image on the recording medium P.

As shown in FIG. 5, the heating roller 78 is rotatably supported by a frame 81 of the fixing device 25. The nip formation pad 74 is disposed inside an elliptical loop formed by the fixing belt 77 such that the nip formation pad 74 is movable bidirectionally, that is, upward and downward in FIG. 5, in the pressurization direction D1 of the pressing roller 72. The nip formation pad 74 contacts an inner circumferential surface of the fixing belt 77 and the outer circumferential surface of the heating roller 78. Hence, as the heating roller 78 rotates in the rotation direction R3, the heating roller 78 slides over the nip formation pad 74. The flexible fixing belt 77 is looped over the heating roller 78 and the nip formation pad 74 such that the fixing belt 77 contacts the outer circumferential surface of the heating roller 78 and an outer circumferential surface of the nip formation pad 74, thus forming the elliptical loop. The pressing roller 72 is pressed against the nip formation pad 74 via the fixing belt 77 to form the fixing nip N between the pressing roller 72 and the fixing belt 77 contacting each other. That is, the fixing nip N defines an interface between the pressing roller 72 and the fixing belt 77.

The fixing belt 77 is brought into contact with the nip formation pad 74 by pressure from the pressing roller 72 and at the same time the fixing belt 77 generates a tension to recover its circular loop. Thus, the fixing belt 77 comes into contact with the heating roller 78.

Pressure is exerted from the pressing roller 72 upward in FIG. 4 in the pressurization direction D1 and is transmitted to the fixing belt 77, the nip formation pad 74, and the heating roller 78. Accordingly, the pressure is exerted at the fixing nip N between the pressing roller 72 and the fixing belt 77, an interface between the fixing belt 77 and the nip formation pad 74, and an interface between the nip formation pad 74 and the heating roller 78.

A detailed description is now given of a configuration of a separation plate 83.

As shown in FIG. 4, the separation plate 83 is disposed opposite the fixing belt 77 and downstream from an exit of the fixing nip N in a recording medium conveyance direction D2 such that an upstream edge of the separation plate 83 facing the fixing nip N is isolated from the fixing belt 77. The separation plate 83 facilitates separation of the recording medium P from the fixing belt 77. For example, the separation plate 83 has a pivot axis at a downstream end thereof in the recording medium conveyance direction D2. The separation plate 83 includes positioning portions disposed at an upstream end thereof in the recording medium conveyance direction D2 disposed in proximity to the upstream edge of the separation plate 83 and at both lateral ends of the separation plate 83 outboard from a recording medium conveyance span corresponding to a width of the recording medium P in the axial direction of the heating roller 78. Biasing members (e.g., springs) connected to the lateral ends of the separation plate 83 bias the separation plate 83 with respect to the fixing belt 77, creating a slight gap between the upstream edge of the separation plate 83 and the fixing belt 77. With this configuration of the separation plate 83, the separation plate 83 guides the recording medium P discharged from the exit of the fixing nip N and separated from the fixing belt 77 by itself to an outside of the fixing device 25, thus preventing the recording medium P from being wound around the fixing belt 77.

A detailed description is now given of a construction of the heater pair 84.

As shown in FIG. 4, the heater pair 84 is situated inside the hollow, tubular heating roller 78 and constructed of heaters 84*a* and 84*b*. Each of the heaters 84*a* and 84*b* may be a halogen heater, an infrared heater, an induction heater, a resistance heat generator, or the like. Alternatively, the heaters 84*a* and 84*b* may be situated outside the heating roller 78.

A detailed description is now given of a configuration of temperature detectors that detect the temperature of the fixing belt 77 and the pressing roller 72.

As shown in FIG. 4, a thermopile 85 is disposed opposite an outer circumferential surface of the fixing belt 77 at a position in proximity to a separation position where the fixing belt 77 looped over the heating roller 78 separates from the heating roller 78 and upstream from the fixing nip N in the rotation direction R3 of the heating roller 78. The thermopile 85 detects the temperature of the outer circumferential surface of the fixing belt 77. The thermopile 85 is spaced apart from the outer circumferential surface of the fixing belt 77 as shown in FIG. 4 and disposed opposite a recording medium conveyance span S1 on the fixing belt 77 through which the recording medium P is conveyed as shown in FIG. 5. The recording medium conveyance span S1 spans in an axial direction of the fixing belt 77 and corresponds to the width of the recording medium P.

As shown in FIG. 4, a thermistor 87*a* is disposed opposite the outer circumferential surface of the fixing belt 77 at a position where the fixing belt 77 contacts the heating roller 78, detecting the temperature of the outer circumferential surface of the fixing belt 77. The thermistor 87*a* contacts the outer circumferential surface of the fixing belt 77 at a position outboard from the recording medium conveyance span S1 in the axial direction of the fixing belt 77 as shown in FIG. 5.

A controller, that is, a central processing unit (CPU) provided with a random-access memory (RAM) and a read-only memory (ROM), for example, is operatively connected to the thermister 87*a*, the thermopile 85, and the heater pair 84. The controller controls the heater pair 84 to maintain the temperature of the heating roller 78 at a target temperature. For example, the controller turns on and off the heater pair 84 based on the temperature of the fixing belt 77 detected by the thermistor 87*a* when the fixing belt 77 halts. Conversely, the controller turns on and off the heater pair 84 based on the temperature of the fixing belt 77 detected by the thermopile 85 when the fixing belt 77 rotates.

Similarly, a heater 86 (e.g., a halogen heater) is situated inside the pressing roller 72. A thermistor 87*b* is pressed against an outer circumferential surface of the pressing roller 72. The controller is also operatively connected to the heater 86 and the thermistor 87*b* to control the heater 86 so as to maintain the temperature of the pressing roller 72 at a target temperature. For example, the controller turns on and off the heater 86 based on the temperature of the pressing roller 72 detected by the thermistor 87*b*. Alternatively, the pressing roller 72 may not accommodate the heater 86.

Upstream from an entry to the fixing nip N in the recording medium conveyance direction D2 is an entry guide 88 that guides the recording medium P to the fixing nip N.

Although an abutment portion of the thermistor 87*a* and the separation plate 83 contacts the outer circumferential surface of the fixing belt 77, the abutment portion of the thermistor 87*a* and the separation plate 83 is situated outboard from the recording medium conveyance span S1 on the fixing belt 77. Accordingly, the abutment portion of the thermistor 87*a* and the separation plate 83 does not produce abrasion on the fixing belt 77 in the recording medium conveyance span S1 thereof, which may be transferred onto the toner image on the recording medium P conveyed through the fixing nip N. Consequently, the toner image on the recording medium P may not be degraded by abrasion produced on the fixing belt 77.

A detailed description is now given of a construction of the pressing roller 72 and its peripheral components.

As shown in FIG. 5, the pressing roller 72 is constructed of a metal pipe made of steel or the like and a silicone rubber layer coating the metal pipe and having a thickness of about 2 mm. The pressing roller 72 has a diameter of about 50 mm and includes a journal 60 at each lateral end in an axial direction thereof. The journal 60 has a diameter of about 20 mm. A bearing 61 is supported by each journal 60. As shown in FIG. 4, a pressing lever 82 is pivotally mounted on the frame 81 at each lateral end of the pressing roller 72 in the axial direction thereof. As shown in FIGS. 4 and 5, a spring 62 is anchored to the pressing lever 82 and the frame 81. The spring 62 biases the pressing lever 82 against the bearing 61 to move the pressing roller 72 toward the heating roller 78. Thus, the spring 62 and the pressing lever 82 constitute a pressurization assembly 6 that presses the pressing roller 72 against the nip formation pad 74 via the fixing belt 77. As a driving force generated by a driver is transmitted to a gear 63 mounted on a lateral end of one of the journals 60, the gear 63 rotates counterclockwise in FIG. 4 in a rotation direction R4, thus rotating the pressing roller 72 in the rotation direction R4. The rotating pressing roller 72 rotates the fixing belt 77 in the rotation direction R3 by friction therebetween at the fixing nip N.

A detailed description is now given of a configuration of the heating roller 78 and its peripheral components.

The heating roller 78 is a conductive, hollow aluminum pipe or tube having a thickness in a range of from about 0.5 mm to about 3.0 mm and a diameter of about 50 mm. The outer circumferential surface of the heating roller 78 is anodized or coated with fluoroplastic to prevent abrasion caused by friction between the heating roller 78 and the fixing belt 77 sliding thereover and between the nip formation pad 74 and the heating roller 78 sliding thereover. An inner circumferential surface of the heating roller 78 is treated with heat-resistant black coating to facilitate absorption of heat from the heaters 84*a* and 84*b*.

As shown in FIG. 5, both lateral ends of the heating roller 78 in the axial direction thereof are rotatably supported by the frame 81 via bearings 64, respectively. As the heating roller 78 is driven and rotated by the fixing belt 77 rotating in the rotation direction R3 by friction therebetween, the heating roller 78 heats the fixing belt 77. The heating roller 78 has a rigidity great enough to prevent bending thereof even if the heating roller 78 receives pressure from the pressing roller 72.

A detailed description is now given of a configuration of the nip formation pad 74.

As shown in FIG. 4, the nip formation pad 74 includes an upper face contacting the heating roller 78 sliding thereover and a lower face contacting the fixing belt 77 sliding thereover. A length of the nip formation pad 74 in the recording medium conveyance direction D2 is smaller than an outer diameter of the heating roller 78 and greater than a length of the fixing nip N in the recording medium conveyance direction D2. A vertical height of the nip formation pad 74 in a direction substantially perpendicular to the recording medium conveyance direction D2, that is, a vertical direction in FIG. 4, has a dimension that allows the fixing belt 77 to be stretched over the heating roller 78 and the nip formation pad 74 loosely.

The nip formation pad 74 is made of heat resistant resin having a desired heat resistance that resists and reduces heat conducted from the heating roller 78 and a desired sliding property that allows the heating roller 78 to slide over the nip formation pad 74 smoothly. For example, the nip formation pad 74 is made of polyphenylene sulfide (PPS), polyamide-imide (PAI), polyimide (PI), liquid crystal polymer (LCD), or the like. Since the nip formation pad 74 includes two slide faces, that is, a first slide face over which the fixing belt 77 slides and a second slide face over which the heating roller 78 slides, the first slide face and the second slide face of the nip formation pad 74 are coated with resin, such as fluoroplastic, that facilitates sliding of the fixing belt 77 and the heating roller 78 over the nip formation pad 74.

Figure 6:
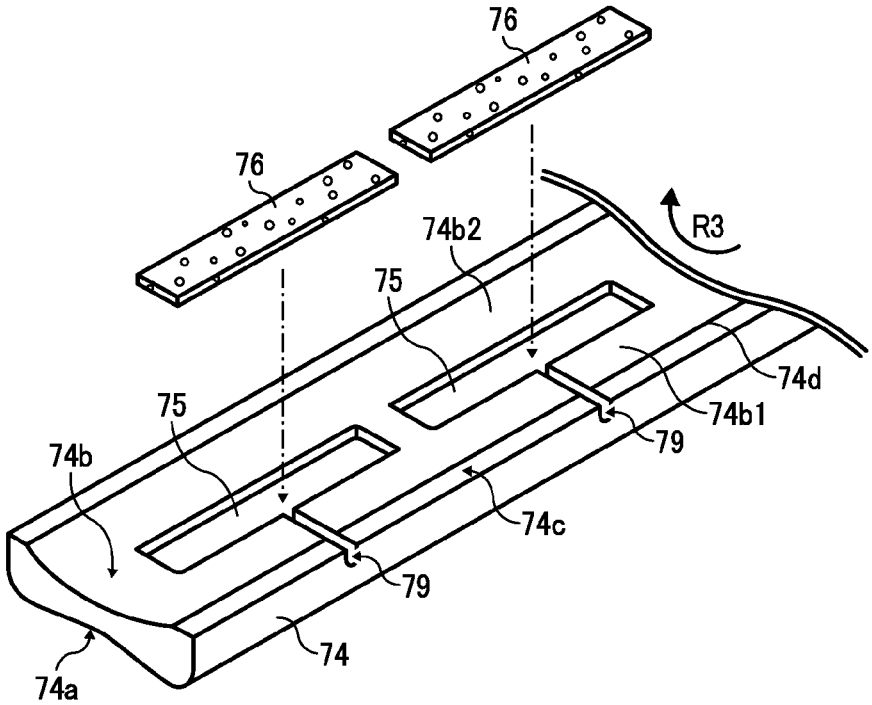
FIG. 6 is a perspective view of a nip formation pad incorporated in the fixing device shown in FIG. 4.

With reference to FIG. 6, a detailed description is now given of a configuration of the first slide face and the second slide face of the nip formation pad 74.

FIG. 6 is a perspective view of the nip formation pad 74. As shown in FIG. 6, a first slide face 74*a* contacting the inner circumferential surface of the fixing belt 77 is curved to correspond to the curved outer circumferential surface of the pressing roller 72 pressed against the nip formation pad 74 via the fixing belt 77 so as to form the curved fixing nip N between the pressing roller 72 and the fixing belt 77. Similarly, a second slide face 74*b* contacting the outer circumferential surface of the heating roller 78 is curved to correspond to the curved outer circumferential surface of the heating roller 78 so as to transmit pressure from the pressing roller 72 to the heating roller 78.

As shown in FIG. 6, a lubricant applicator 76 is mounted on the second slide face 74*b* of the nip formation pad 74 to apply a lubricant to the outer circumferential surface of the heating roller 78. Since the lubricant applicator 76 is embedded in the second slide face 74*b* of the nip formation pad 74 that contacts the outer circumferential surface of the heating roller 78, without another lubricant applicator for applying the lubricant to the inner circumferential surface of the fixing belt 77 and a space accommodating such lubricant applicator, the lubricant applicator 76 applies the lubricant to the inner circumferential surface of the fixing belt 77 through the heating roller 78, thus saving space and reducing manufacturing costs.

The second slide face 74*b* of the nip formation pad 74 is produced with a plurality of recesses 75 that accommodates a plurality of lubricant applicators 76, respectively. Each lubricant applicator 76 engages each recess 75, thus being embedded in the recess 75 produced in the second slide face 74*b* of the nip formation pad 74. The second slide face 74*b* includes an upstream portion 74*b*1 situated upstream from the recess 75 and a downstream portion 74*b*2 situated downstream from the recess 75 in the rotation direction R3 of the heating roller 78. The upstream portion 74*b*1 comes into contact with a particular section on the heating roller 78 before the downstream portion 74*b*2 does. Since the heating roller 78 slides over the upstream portion 74*b*1 and the downstream portion 74*b*2 of the second slide face 74*b* of the nip formation pad 74, the upstream portion 74*b*1 and the downstream portion 74*b*2 adjust an amount of the lubricant applied to the heating roller 78. Accordingly, the nip formation pad 74 allows the lubricant applicator 76 to apply the lubricant to the heating roller 78 evenly without a separate component that adjusts the amount of the lubricant applied to the heating roller 78, saving space and reducing manufacturing costs.

The lubricant applicator 76 may be made of a material that retains an increased amount of the lubricant for long term application. For example, the lubricant applicator 76 is advantageous compared to a configuration in which the lubricant is merely applied to the inner circumferential surface of the fixing belt 77 in advance. The lubricant applicator 76 is made of felt impregnated with the lubricant, for example, heat resistant felt made of aramid fiber. The lubricant impregnated in the felt may be heat resistant grease such as fluorine grease and silicone oil grease.

The thickness of the lubricant applicator 76 may be greater than the depth of the recess 75. As the pressing roller 72 is pressed against the nip formation pad 74 via the fixing belt 77 as shown in FIG. 4, the lubricant applicator 76 is pressed against the heating roller 78 to have a decreased thickness, applying the lubricant to the outer circumferential surface of the heating roller 78 rotating in the rotation direction R3. The lubricant applied to the outer circumferential surface of the heating roller 78 is leveled by the second slide face 74*b* of the nip formation pad 74 that surrounds the lubricant applicator 76. Thus, the lubricant evenly applied to the outer circumferential surface of the heating roller 78 reduces frictional resistance between the nip formation pad 74 and the heating roller 78 sliding thereover.

The lubricant applied to the outer circumferential surface of the heating roller 78 moves to the inner circumferential surface of the fixing belt 77, reducing frictional resistance between the nip formation pad 74 and the fixing belt 77 sliding thereover.

The upstream portion 74*b*1 of the second slide face 74*b* of the nip formation pad 74 includes a lubricant collection face 74*c* that collects and stores redundant lubricant. The lubricant collection face 74*c* is produced with a groove 79 in communication with the recess 75. The redundant lubricant applied to the outer circumferential surface of the heating roller 78 is regulated by an upstream edge 74*d* of the nip formation pad 74 that comes into contact with the heating roller 78 before other section of the nip formation pad 74 does and accumulated on the lubricant collection face 74*c*. Thereafter, the redundant lubricant on the lubricant collection face 74*c* falls into the groove 79 and moves to the recess 75 through the groove 79, being absorbed and collected into the lubricant applicator 76 embedded in the recess 75.

FIG. 6 illustrates the two grooves 79. Alternatively, one groove 79 or three or more grooves 79 may be produced in the nip formation pad 74. Further, the shape of the groove 79 is not limited to that illustrated in FIG. 6.

A detailed description is now given of a construction of the fixing belt 77.

The fixing belt 77 is an endless belt having a loop diameter of about 58 mm and constructed of a base layer made of heat-resistant resin such as polyimide and having a thickness in a range of from about 0.05 mm to about 0.20 mm; an inner surface release layer coating the base layer; and an outer surface release layer coating the base layer. The outer surface release layer is made of silicone rubber, fluoroplastic, silicone rubber and fluoroplastic constituting a double layer, mixture of silicone rubber and fluoroplastic, or the like. Thus, the outer surface release layer attains elasticity great enough to correspond to asperities of the toner image on the recording medium P. The inner surface release layer is coated with fluoroplastic that reduces frictional resistance between the nip formation pad 74 and the fixing belt 77 sliding thereover. According to this example embodiment, the base layer of the fixing belt 77 is made of resin. Alternatively, the base layer may be made of metal, such as stainless steel, nickel, and copper, rubber, or the like.

As shown in FIG. 4, the fixing belt 77 having the construction described above is heated by the heaters 84*a* and 84*b* via the heating roller 78 while the fixing belt 77 is wound around the heating roller 78 having a relatively great diameter. As the heated fixing belt 77 passes through the fixing nip N, the fixing belt 77 applies heat and pressure to the recording medium P conveyed through the fixing nip N, thus fixing the toner image on the recording medium P.

As described above, since the heating roller 78 and the nip formation pad 74 receive pressure from the pressing roller 72 at the fixing nip N, without increasing the size and the mechanical strength of the nip formation pad 74, the heating roller 78 and the nip formation pad 74 form the fixing nip N having an increased length in the recording medium conveyance direction D2 and exerted with increased pressure between the pressing roller 72 and the fixing belt 77. Thus, the fixing device 25 forms the high quality toner image on the recording medium P at high speed. Further, the downsized nip formation pad 74 in contact with the heating roller 78 attains a decreased circumferential length of the fixing belt 77, downsizing the fixing device 25. The shape of the nip formation pad 74 that increases the curvature of the fixing belt 77 at the exit of the fixing nip N facilitates separation of the recording medium P from the fixing belt 77. As a result, the recording medium P separates from the fixing belt 77 by itself readily. Since the heating roller 78 contacts the fixing belt 77 while rotating in the rotation direction R3, heat is conducted from the heating roller 78 to the fixing belt 77 effectively.

As shown in FIG. 6, the lubricant applicator 76 is mounted on the second slide face 74*b* of the nip formation pad 74 over which the heating roller 78 slides. Accordingly, the lubricant applicator 76 applies the lubricant to the outer circumferential surface of the heating roller 78 which in turn applies the lubricant to the inner circumferential surface of the fixing belt 77. That is, the lubricant is applied to the heating roller 78 and the fixing belt 77 evenly for an extended period of time with the simple structure. Consequently, the frictional resistance between the nip formation pad 74 and the heating roller 78 sliding thereover and the frictional resistance between the nip formation pad 74 and the fixing belt 77 sliding thereover are reduced.

According to this example embodiment shown in FIG. 4, the pressurization assembly 6 presses the pressing roller 72 against the nip formation pad 74 via the fixing belt 77. Alternatively, the pressurization assembly 6 may contact the heating roller 78 to press the heating roller 78 against the pressing roller 72 via the nip formation pad 74 and the fixing belt 77. In this case, the pressing roller 72 is mounted on the frame 81. Yet alternatively, the pressurization assemblies 6 may contact the pressing roller 72 and the heating roller 78, respectively. In this case, the nip formation pad 74 may be mounted on the frame 81 so that one pressurization assembly 6 presses the heating roller 78 against the nip formation pad 74 and another pressurization assembly 6 presses the pressing roller 72 against the nip formation pad 74 via the fixing belt 77.

Figure 7:
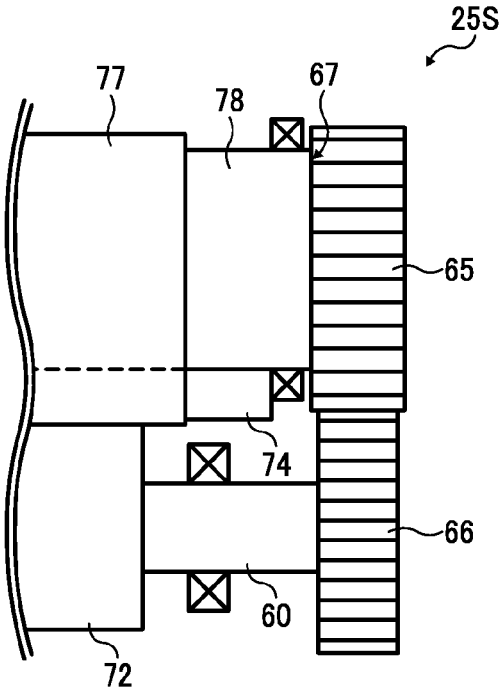
FIG. 7 is a partial side view of a fixing device according to a second example embodiment.

With reference to FIG. 7, a description is provided of a configuration of a fixing device 25S according to a second example embodiment.

FIG. 7 is a partial side view of the fixing device 25S. Since the fixing belt 77 drives and rotates the heating roller 78, the fixing belt 77 and the heating roller 78 rotate at an identical speed, preventing abrasion and wear of the fixing belt 77 and the heating roller 78. However, as the heating roller 78 is rotated by the fixing belt 77, the heating roller 78 slides over the nip formation pad 74. Accordingly, if a frictional resistance between the nip formation pad 74 and the fixing belt 77 sliding thereover is greater than a driving force of the fixing belt 77 that drives and rotates the heating roller 78, the frictional resistance may halt the heating roller 78. If the heating roller 78 halts, the heating roller 78 may heat the fixing belt 77 ineffectively and may be a resistance that halts the fixing belt 77.

To address this circumstance, as shown in FIG. 7, the pressing roller 72 and the heating roller 78 are geared together by intermeshing, first gear 65 and second gear 66. The first gear 65 mounted on the heating roller 78 engages the second gear 66 mounted on the journal 60 of the pressing roller 72. The heating roller 78 is coupled to the first gear 65 through a one-way clutch 67. Thus, the first gear 65, the second gear 66, and the one-way clutch 67 constitute a rotation mechanism. The heating roller 78 is driven and rotated by the fixing belt 77 and the first gear 65 rotates at a rotation speed slower than a rotation speed of the heating roller 78 by several percent in a range of from about 1 percent to about 5 percent.

Accordingly, in a state in which the rotation speed of the heating roller 78 is higher than the rotation speed of the first gear 65 of the heating roller 78, the one-way clutch 67 is free. Conversely, as the rotation speed of the heating roller 78 decreases due to slippage, the rotation speed of the heating roller 78 is identical to the rotation speed of the first gear 65 of the heating roller 78 and the one-way clutch 67 locks, driving and rotating the heating roller 78 at the number of rotations smaller by several percent. Thus, even if slippage occurs between the fixing belt 77 and the heating roller 78, the driven heating roller 78 rotates the fixing belt 77, preventing the fixing belt 77 from being halted by slippage.

As described above, the fixing belt 77 is driven and rotated by the pressing roller 72. However, since the fixing belt 77 rotates in the rotation direction R3 as shown in FIG. 4 while sliding over the nip formation pad 74, if the frictional resistance between the nip formation pad 74 and the fixing belt 77 sliding thereover is greater than the driving force of the pressing roller 72 that drives and rotates the fixing belt 77, the fixing belt 77 may halt. For example, as the recording medium P is conveyed through the fixing nip N, the recording medium P sandwiched between the pressing roller 72 and the fixing belt 77 may decrease the driving force of the pressing roller 72 that drives and rotates the fixing belt 77. If the fixing belt 77 halts, the fixing belt 77 may not convey the recording medium P through the fixing nip N.

To address this circumstance, as shown in FIG. 7, the heating roller 78 and the pressing roller 72 are geared together by the intermeshing, first gear 65 and second gear 66, thus driving and rotating the heating roller 78.

The rotation speed of the heating roller 78 is equivalent to the rotation speed of the fixing belt 77 driven by the pressing roller 72 within 1 percent error or is higher than the rotation speed of the fixing belt 77 driven by the pressing roller 72 by a range of from about 0 percent to about 10 percent.

The inner circumferential surface of the fixing belt 77 coated with fluoroplastic and applied with the lubricant is susceptible to slippage at an interface with the outer circumferential surface of the heating roller 78. Accordingly, even if the heating roller 78 rotates at a rotation speed different from that of the fixing belt 77, the fixing belt 77 slips over the heating roller 78 stably without degradation in movement of the fixing belt 77. However, the fixing belt 77 may be driven. In this case, abrasion and wear caused by the difference between the rotation speed of the heating roller 78 and the rotation speed of the fixing belt 77 should be noted.

As described above, the recording medium P conveyed between the pressing roller 72 and the fixing belt 77 decreases the driving force of the pressing roller 72 that drives and rotates the fixing belt 77. However, the driving force of the heating roller 78 that drives and rotates the fixing belt 77 prevents the fixing belt 77 from being halted. Further, the heating roller 78 driving and rotating the fixing belt 77 prevents the heating roller 78 from being halted by slippage of the fixing belt 77 over the heating roller 78.

Alternatively, the rotation speed of the heating roller 78 may be slower than that of the fixing belt 77. In this case, however, the heating roller 78 may be a resistance to rotation of the fixing belt 77, slackening the fixing belt 77 at the exit of the fixing nip N and hindering stable separation of the recording medium P from the fixing belt 77. To address this circumstance, the heating roller 78 is rotated at a rotation speed equivalent to the rotation speed of the fixing belt 77 within 1 percent error or higher than the rotation speed of the fixing belt 77 by a range of from about 0 percent to about 10 percent.

Figure 8:
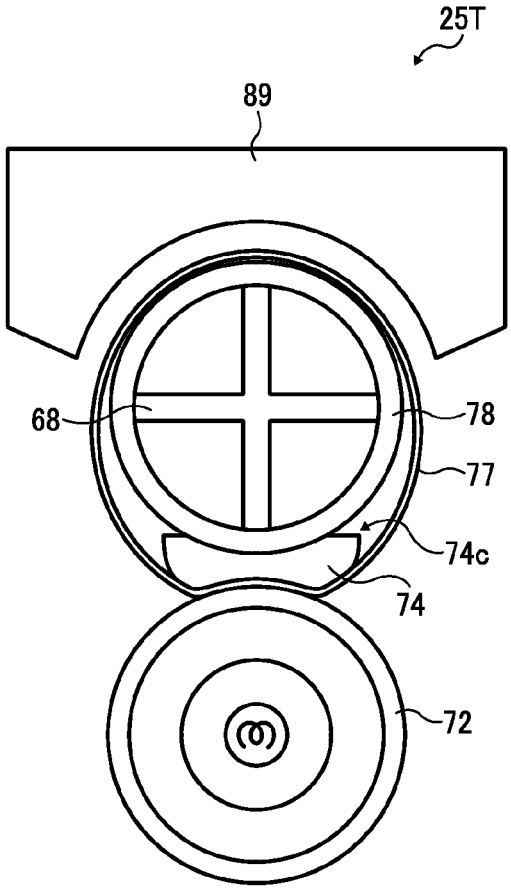
FIG. 8 is a vertical sectional view of a fixing device according to a third example embodiment.

With reference to FIG. 8, a description is provided of a configuration of a fixing device 25T according to a third example embodiment.

FIG. 8 is a vertical sectional view of the fixing device 25T. As shown in FIG. 8, the fixing device 25T includes an induction heater 89, serving as a heater, situated outside the heating roller 78. The induction heater 89 is disposed opposite the outer circumferential surface of the heating roller 78 via the fixing belt 77 with an interval between the outer circumferential surface of the fixing belt 77 and the induction heater 89. The induction heater 89 generates a magnetic flux toward a heat generation layer incorporated in the fixing belt 77 so that the heat generation layer generates heat by the magnetic flux. Alternatively, similar to the heaters 84*a* and 84*b* depicted in FIG. 4, the induction heater 89 may be disposed opposite the inner circumferential surface of the heating roller 78 to heat the heating roller 78 which in turn heats the fixing belt 77 indirectly.

Since the induction heater 89 is spaced apart from the outer circumferential surface of the fixing belt 77, no heater is situated inside the hollow heating roller 78, allowing the heating roller 78 to accommodate a rib 68. The rib 68 disposed opposite the inner circumferential surface of the heating roller 78 increases the mechanical strength of the heating roller 78 so that the heating roller 78 endures increased pressure from the pressing roller 72.

With reference to FIGS. 4 and 6, a description is provided of advantages of the fixing devices 25, 25S, and 25T.

As shown in FIG. 4, the fixing devices 25, 25S, and 25T include the heating roller 78 serving as an interior rotary body rotatable in the rotation direction R3; the heater pair 84 serving as a heater or a heat source that heats the heating roller 78; the nip formation pad 74 that contacts a part of the outer circumferential surface of the heating roller 78 such that the heating roller 78 slides over the nip formation pad 74; the flexible, endless fixing belt 77 looped over the heating roller 78 and the nip formation pad 74; and the pressing roller 72 serving as a pressing rotary body pressed against the nip formation pad 74 via the fixing belt 77 to form the fixing nip N between the pressing roller 72 and the fixing belt 77. The pressing roller 72, the fixing belt 77, the nip formation pad 74, and the heating roller 78 are aligned in this order in the pressurization direction D1 in which the pressing roller 72 exerts pressure to the heating roller 78 via the fixing belt 77 and the nip formation pad 74 to form the fixing nip N. As shown in FIG. 6, the fixing devices 25, 25S, and 25T further include the lubricant applicator 76 mounted on the nip formation pad 74 to apply a lubricant to the outer circumferential surface of the heating roller 78.

Accordingly, the fixing belt 77 looped over the heating roller 78 and the nip formation pad 74 form the fixing nip N having an increased length in the recording medium conveyance direction D2 and exerted with increased pressure between the pressing roller 72 and the fixing belt 77 without upsizing the nip formation pad 74, thus downsizing the fixing devices 25, 25S, and 25T. Additionally, the lubricant applicator 76 decreases the frictional resistance between the nip formation pad 74 and the heating roller 78 sliding thereover and the frictional resistance between the nip formation pad 74 and the fixing belt 77 sliding thereover stably for an extended period of time.

According to the example embodiments described above, the fixing belt 77 serves as a flexible fixing belt. Alternatively, an endless film or the like may be used as a fixing belt. Further, the pressing roller 72 serves as a pressing rotary body. Alternatively, a pressing belt or the like may be used as a pressing rotary body.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. A fixing device comprising:

an interior rotary body rotatable in a given direction of rotation;

a heater disposed opposite and heating the interior rotary body;

a nip formation pad contacting a part of an outer circumferential surface of the interior rotary body sliding thereover;

a flexible fixing belt looped over the interior rotary body and the nip formation pad;

a pressing rotary body pressed against the nip formation pad via the fixing belt to form a fixing nip between the pressing rotary body and the fixing belt; and a lubricant applicator mounted on the nip formation pad to apply a lubricant to the outer circumferential surface of the interior rotary body, wherein the pressing rotary body, the fixing belt, the nip formation pad, and the interior rotary body are aligned in this order in a pressurization direction in which the pressing rotary body exerts pressure to the interior rotary body via the fixing belt and the nip formation pad to form the fixing nip.

2. The fixing device according to claim 1, wherein the nip formation pad includes a slide face, over which the interior rotary body slides, mounting the lubricant applicator.

3. The fixing device according to claim 2, wherein the slide face of the nip formation pad levels the lubricant applied to the outer circumferential surface of the interior rotary body.

4. The fixing device according to claim 1, wherein the nip formation pad includes a recess embedded with the lubricant applicator.

5. The fixing device according to claim 4, wherein a thickness of the lubricant applicator is greater than a depth of the recess.

6. The fixing device according to claim 4, wherein the nip formation pad further includes a lubricant collection face, disposed upstream from the recess in the direction of rotation of the interior rotary body, to receive the redundant lubricant.

7. The fixing device according to claim 6, wherein the nip formation pad further includes a groove produced in a part of the lubricant collection face and in communication with the recess.

8. The fixing device according to claim 7, wherein the lubricant received by the lubricant collection face of the nip formation pad falls into the groove and moves to the lubricant applicator embedded in the recess.

9. The fixing device according to claim 1, wherein the lubricant applicator is made of felt impregnated with the lubricant.

10. The fixing device according to claim 1, wherein the interior rotary body includes a tube.

11. The fixing device according to claim 10, wherein the heater includes an infrared heater disposed inside the tube of the interior rotary body.

12. The fixing device according to claim 10, wherein the heater includes an induction heater disposed inside the tube of the interior rotary body.

13. The fixing device according to claim 1, wherein the heater includes an induction heater disposed opposite the outer circumferential surface of the interior rotary body.

14. The fixing device according to claim 13, further comprising a rib contacting an inner circumferential surface of the interior rotary body.

15. The fixing device according to claim 1, further comprising:

a first gear mounted on the interior rotary body;

a second gear mounted on the pressing rotary body and engaging the first gear; and a one-way clutch through which the interior rotary body is coupled to the first gear.

16. The fixing device according to claim 15, wherein the pressing rotary body drives and rotates the interior rotary body through the second gear, the first gear, and the one-way clutch.

17. An image forming apparatus comprising the fixing device according to claim 1.

* * * * *